United States Patent [19]

Nishimori et al.

[11] Patent Number: 4,994,865

[45] Date of Patent: Feb. 19, 1991

[54] COPYING APPARATUS

[75] Inventors: Kadotaro Nishimori; Masazumi Ito; Kimihiko Higashio; Akio Kato, all of Osaka, Japan

[73] Assignee: Minolta Camera Kabushiki Kaisha, Osaka, Japan

[21] Appl. No.: 400,867

[22] Filed: Aug. 30, 1989

[30] Foreign Application Priority Data

Aug. 31, 1988 [JP] Japan ..... 63-219294

[51] Int. Cl.[5] ..... G03G 21/00

[52] U.S. Cl. ..... 355/324; 355/208

[58] Field of Search ..... 355/324, 321, 208; 271/287, 288

[56] References Cited

U.S. PATENT DOCUMENTS 4,134,672 1/1979 Burlew et al. ..... 355/324
4,444,491 4/1984 Rinehart et al. ..... 355/324 X
4,721,382 1/1988 Ito et al. ..... 355/206
4,864,350 9/1989 Ishiguro et al. ..... 355/324 X

FOREIGN PATENT DOCUMENTS 55-15150 2/1980 Japan .

*Primary Examiner*—A. T. Grimley
*Assistant Examiner*—Sandra L. Hoffman
*Attorney, Agent, or Firm*—Burns, Doane, Swecker & Mathis

[57] ABSTRACT

The number of copied sheets of paper accommodated in a staple tray for stapling process are counted by a counter. A transport path changeover member is switched over from a guide position to convey copy paper to the staple tray to a guide position to convey the copy paper to another discharge tray where stapling process is not performed corresponding to the counter value reaching the limit of stapling process. The copied sheets are, thereafter, guided to the discharge tray to continue on copying operation.

9 Claims, 12 Drawing Sheets

80
100
131
200
133
220
50
190
70
36
18
150
160
215
17
37
16
30
7
3
2
31
9
8
6
2a
4
35
32
5
15
33
34
1
10
11
45

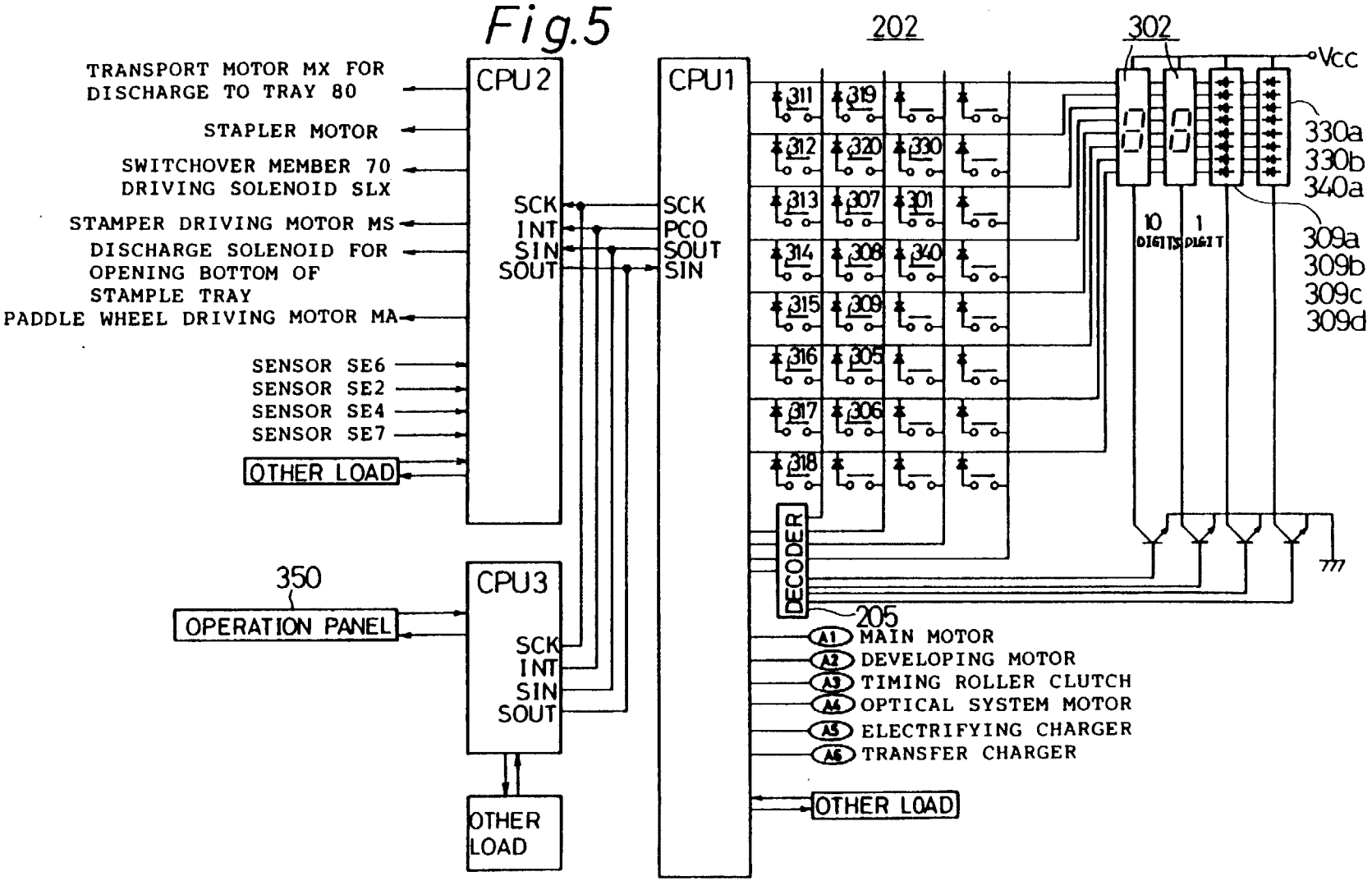
Fig.5
Vcc
330a
330b
340a
309a
309b
309c
309d
302
202
10 DIGIT
1 DIGIT
311
312
313
314
315
316
317
318
319
320
307
308
309
305
306
330
301
340
DECODER
205
A1 MAIN MOTOR
A2 DEVELOPING MOTOR
A3 TIMING ROLLER CLUTCH
A4 OPTICAL SYSTEM MOTOR
A5 ELECTRIFYING CHARGER
A6 TRANSFER CHARGER
OTHER LOAD
CPU1
SCK
PCO
SOUT
SIN
CPU2
SCK
INT
SIN
SOUT
CPU3
SCK
INT
SIN
SOUT
OTHER LOAD
TRANSPORT MOTOR MX FOR DISCHARGE TO TRAY 80
STAPLER MOTOR
SWITCHOVER MEMBER 70 DRIVING SOLENOID SLX
STAMPER DRIVING MOTOR MS
DISCHARGE SOLENOID FOR OPENING BOTTOM OF STAMPLE TRAY
PADDLE WHEEL DRIVING MOTOR MA
SENSOR SE6
SENSOR SE2
SENSOR SE4
SENSOR SE7
OTHER LOAD
350
OPERATION PANEL

COPYING APPARATUS

BACKGROUND OF THE INVENTION

1. Technical Field of the Invention

The present invention relates to a copying apparatus, and more particularly to a copying apparatus which is provided with a discharge tray for discharging image recorded copy paper sheets without stapling or stamping, a staple or stamp tray for collecting the recorded sheets and a changeover device for guiding the sheets either to the discharge tray or to the staple tray wherein the changeover guiding device guides the recorded sheets to the staple tray under staple mode in which the recorded sheets are collected and stapled or stamped.

2. Brief Description of Related Art

In this kind of copying apparatus, it has heretofore been arranged to stop copying operation in the main body to prohibit copying operation when copied sheets are transported on the staple tray exceeding paper stack capacity under staple mode. Moreover, in some occasions, it happens that the sheets on the staple or stamp tray are stapled or stamped as they are, and such action is not always preferable. For instance, when it is required to successively copy a set of all originals without interruption or when it is preferable to staple all the copied sheets corresponding to a set of the originals by a machine which is provided with circulation type original forwarding device, such actions as described above are interrupted.

In U.S. Pat. No. 4,134,672, there is disclosed a finisher of copying machine capable of continuously performing copying operation even if the containable number of copied sheets on a staple tray exceeds the limit for stapling process. It further accommodates copied sheets, however, it does not perform stapling process and can not deal with the case when the number of sheets exceeds the limit of accommodation. For instance, it may occasionally happen that the number of sheets exceed the limit of accommodation when operator does not know the limit of accommodation on the staple tray or without knowing the number of sheets of originals. In such a case, it has to be arranged to prohibit further copying operation and stop newly forward copy sheets from being guided into the staple tray.

SUMMARY OF THE INVENTION

The main object of the present invention is to provide a copying apparatus which is capable of continuously performing and finishing copying operation by changing over a sheet handling process when the number of copied sheets accommodated on the staple or stamp tray has exceeded the limit of stapling process under staple mode.

Another object of the present invention is to provide a copying apparatus which is capable of accomplishing continuous copying operation by a simple mechanism and control without any trouble, wherein a discharge tray which does not perform stapling process and a guide device for guiding copied sheets to the staple tray and to the discharage tray are provided in addition to the staple tray, and when the number of copied sheets accommodated on the staple tray has exceeded the limit for stapling proces, the copy sheets following are guided to the discharge tray by switching over the guide device.

A further object of the present invention is to provide a copying apparatus which is capble of performing a stapling process for the number of copied sheets accommodated on both trays in accordance with requirement, wherein stapling action on the staple tray is prohibited when the guide device is switched over for guiding copied sheet to the discharge tray so that an incomplete process of stapling only a part of the copied sheets is avoided.

These and other objects and features of the present invention will become more apparent from the following description taken in conjunction with the accompanying drawings which illustrate specific embodiments of the invention.

BRIEF DESCRIPTION OF THE DRAWINGS

FIG. 5 is a control circuit.

DESCRIPTION OF THE PREFERRED EMBODIMENT

Embodiments of the present invention will be described below referring to accompanying drawings.

Figure 1:
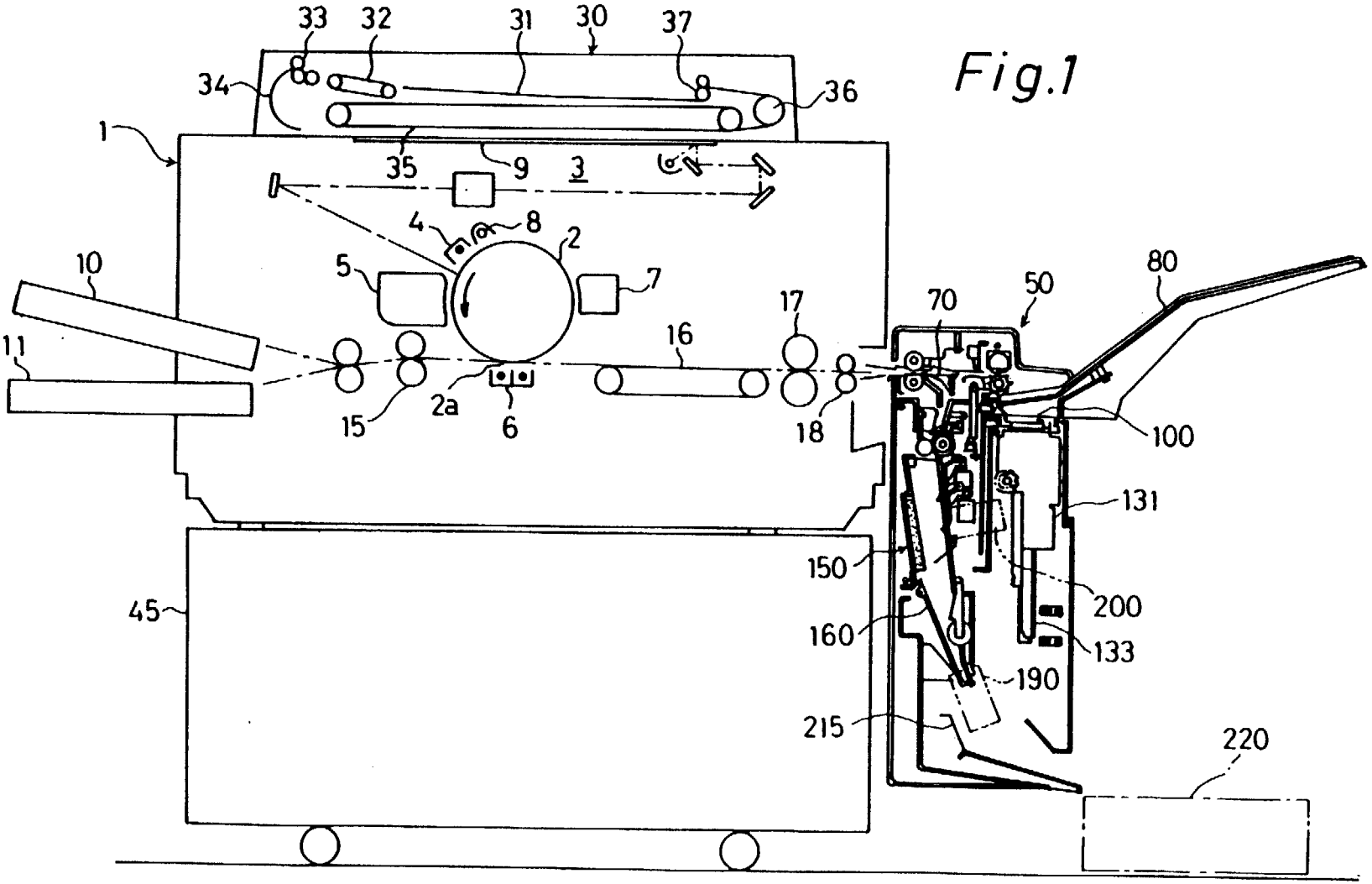
FIG. 1 is a schematic constructional view of a copying apparatus to which the present invention is applied.

FIG. 1 shows a schematic construction of a copying machine to which the present invention is applied. On the main body of the copying machine, there is provided a finisher 50 which is attachable and detachable.

The main body 1 of the copying machine shown in FIG. 1 is placed on a desk 45, and on top of the main body, there is provided a recirculating type automatic document handling device (hereinafter marked as RDH) 30. Inside the main body 1 of the copying machine, there are disposed an optical system 3 and image forming elements such as charger 4, developing unit 5, transfer charger 6, cleaning device 7 and eraser lamp 8 centering around a photoconductive drum 2 which is rotatively driven in the direction of arrow. Descriptions on these elements and copying procedure are omitted since they are already known well.

Sheets of copy paper are accommodated in automatic paper feeding cassettes 10,11 and the sheets are selectively supplied one by one from either one of the cassettes 10,11. The sheet of paper is then transported into transfer section **2*a* in synchronization with a toner image formed on the outer circumference of the photoconductive drum 2. After transfer, the paper is forwarded to a fixing unit 17 by transport belt 16 for fixing process by toner, and thereafter, the paper is discharged through a pair of discharge rollers 18. At this stage, the paper is detected by a sensor SE1 (refer to FIG. 2) arranged just in front of a pair of discharge rollers 18**.

The RDH 30 comprises an original placing tray 31, a paper feeding belt 32, a pair of paper feeding rollers 33, a reversing guide plate 34, a transporting belt 35, a reversing roller 36 and a pair of discharge rollers 37. The RDH 30 is arranged to successively transport originals from the last page, and an original is placed on the tray 31 with its surface to be copied facing upward. The original is drawn out from the last page which is placed undermost by rotation of the paper feeding belt 32 and is sent from the pair of paper feeding rollers 33 into the space between the transporting belt 35 and an original glass table 9 through the reversing guide plate 34. Then, the original is set at a predetermined position on the original glass table 9 by rotation of the transporting belt 35 to receive light irradiation by the optical system 3. The original whose image has been exposed is transported from the original glass table 9 to the right side in FIG. 1 by the transport belt 35, and thereafter, discharged onto the originals placed on the tray 31 with image surface facing upward through the reversing roller 36.

The number of originals and the number of sheets to be copied can be inputted by the main body of the copying machine and the ten keys on the operation panel, and every time when a group of originals has been copied, the group of originals corresponding to the number of sheets set for copying operation is circulated and transported by shifting a paper discharge tray 80 or performing stapling process and interrupting copying operation for carrying out stamping process.

The finisher unit 50 is arranged to selectively accommodate the copy paper sheets discharged from the main body of the copying machine 1 on the paper discharge tray 80 or on a staple or stamp tray 150 to make adjustment for stapling by a stapler 190. Accordingly, when a plurality of sheets are copied and the stapling process, on the stapling and stamping process are performed by use of the RDH30, copy paper sheets are successively accommodated in the staple tray 150 and a signal is emitted that the original from the main body 1 has been circulated, and after adjustment is made on the last sheet of copy paper, the stapler 190 or the stapler 190 and stamper 200 are operated for stapling or stapling and stamping the copy paper sheets. The stapled copy paper sheets are accommodated in a bucket or a stack basket 220.

More particularly, the finisher unit 50 includes rollers 60,61 for receiving copy paper sheets, the discharge tray 80 through which the copy paper sheets are discharged, a staple tray 150 which is provided with a stamper 200 and a stapler 190 into which copy paper sheets corresponding to a group of originals are guided and stapling and stamping procedures are performed, and a changeover claw 70 for switching over the transport path to selectively guide the copy paper sheets received either to the discharge tray 80 or to the staple tray 150.

Figure 2:
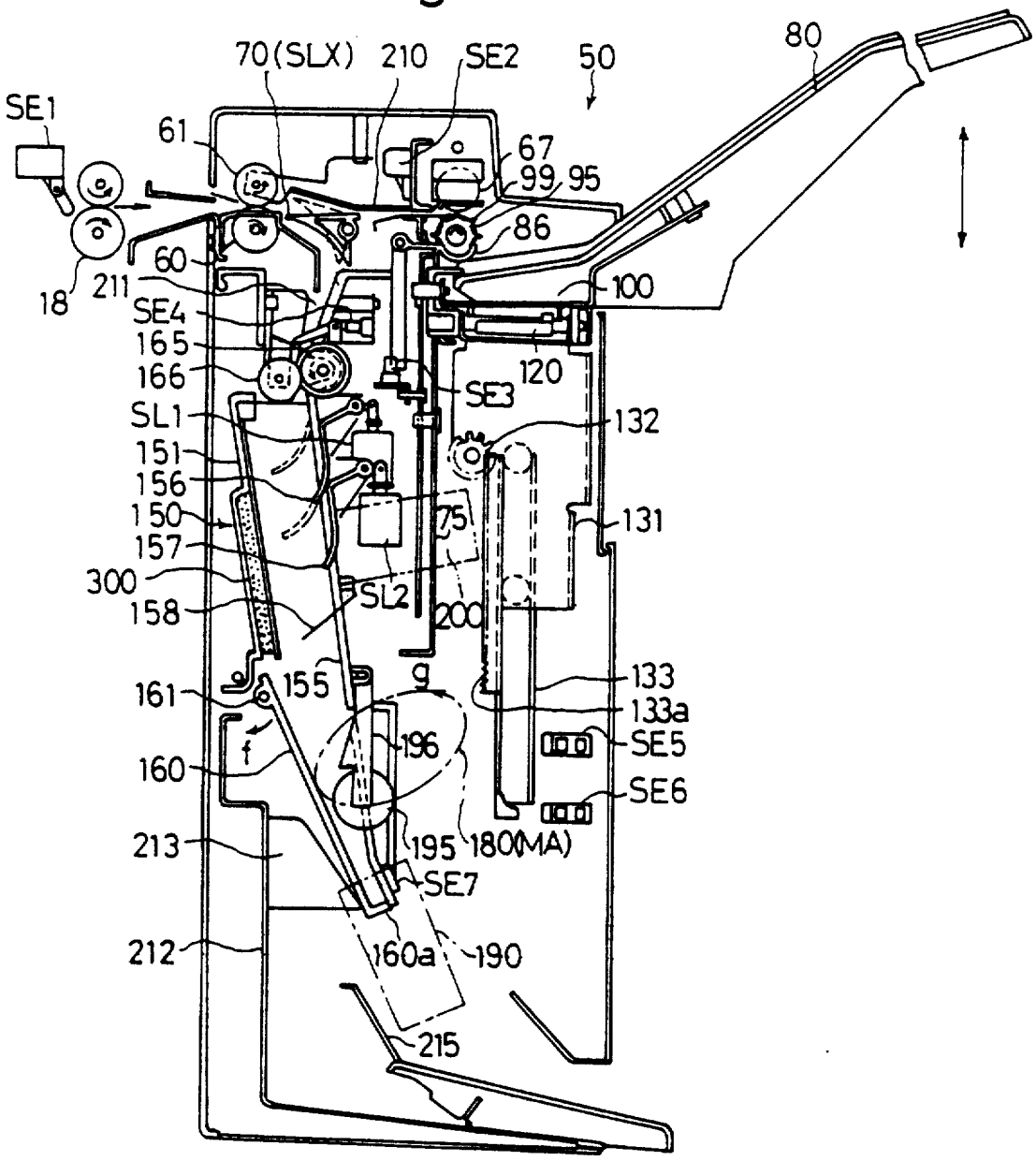
FIG. 2 is an expanded sectional view of a finisher which is provided with a stapler and stamper equipped with a copying apparatus.

The changeover claw 70 is switched over by a solenoid SLX connected thereto by the action of turning on and off of the solenoid either to the position of solid line shown in FIG. 2 which leads to the path 210 extending from the rollers 60,61 to the discharge tray 80 or to the position of broken line shown in FIG. 2 which leads to the path 211 extending from the rollers 60,61 to the staple tray 150.

At the end portion of the transport path 210, there are provided a discharge roller 95 and a plurality of pinch balls 67 which is in contact with the roller with its own weight to send out the copy sheets being guided into the transport path 210 onto the discharge tray 80. Just in front of the discharge roller 95, a sensor SE2 is arranged for detecting the copy paper being discharged. At the end portion of the transport path 211, there are arranged transport rollers 165,166 to forward the copy paper sheets being transported into the path 211 toward the staple tray 150. Just in front of the transport rollers 165,166, a sensor SE4 is arranged for detecting the copy paper being guided.

The discharge tray 80 is fixed to a sheet frame 100 provided on an elevating member 131, and an actuator 86 of a sensor SE3 is positioned on the upper rear portion of the discharge tray 80 for detecting the surface level of a copy paper. The elevating member 131 is able to vertically move the paper discharge tray 80 through the shift frame 100 in accordance with an engaged elevating movement of a pinion 132 provided in the elevating member with a rack **133*a* provided in an elevating guide 133, and lowers the paper discharge tray 80 a predetermined amount every time when the surface level of copy paper has reached a predetermined level. A dropping height of copy paper is thus maintained at a constant height when the copy paper discharged from a discharge outlet 95 and the pinch ball 67** is dropped either onto the tray or onto the copy paper sheets supported by the tray.

The shift frame 100 is shifted on the elevating member 131 by shift mechanism 120 between two positions in the orthogonal direction against the paper discharging direction together with the paper discharge tray. Accordingly, the paper discharge tray 80 receives each group of copy paper sheets being successively discharged corresponding to originals at different positions and is able to place them in a sorted state.

Sensors SE5 and SE6 are disposed at the lower portion of an elevating path of the elevating member 131. When the elevating member 131 has descended down to the position where it is detected by the sensor SE5, the paper discharge tray 80 is fully loaded with copy paper sheets and a signal is outputted to the main body of copying machine informing that any further accommodation of copy paper is infeasible, and an indication is made that copy paper will be removed from the paper discharge tray 80 if it is so required. The elevating member 131 further descends until it is detected by the sensor SE6 to enable stamper 200 to be operated.

On a rotating shaft of the discharge roller 95, there is arranged a paddle 99 which is always in contact with the rear end of a copy paper on the paper discharge tray 80 and acts in a manner to press the copy paper onto a fixed back plate 75 provided along the range of elevating stroke of the paper discharge tray 80 to adjust copy paper sheets. The paddle 99 is arranged to be shifted in cooperation with the paper discharge tray 80 in order not to disturb the copy paper sheets on the paper discharge tray 80.

The staple tray 150 includes a base plate 151, a guide plate 155 and a stopper 160 as shown in FIG. 2, and is stood with some inclination.

On one side of the base plate 151, a stamp receiving stand 300 is disposed opposite to the stamper 200. The stamp receiving stand 300 is made of a soft elastic member in low friction coefficient to the sheet of copy paper in order not to interfere with the actions of receiving copy paper sheets into the tray 150, adjusting the copy paper sheets and discharging the paper from the tray with its surface made smooth, and the height of surface is made substantially the same as that of the tray in order not to protrude above the surface of the tray.

The stopper 160 is arranged to regulate the lower portion of copy paper sheets accommodated in the staple tray 150 and is rotatably supported by a support shaft 161 and connected to a discharge solenoid SLC. The stopper 160 normally closes the bottom of the staple tray 150 by engagement with the guide plate 155 when the discharge solenoid SLC is turned off. When the discharge solenoid is turned on, the stopper 160 starts rotation in the direction of arrow f with the support shaft 161 as fulcrum and opens the bottom of the staple tray 150. At the lower portion of the staple tray 150, there are provided a paddle wheel 180 for adjusting the copy paper sheets accommodated, the stapler 190 for stapling a plurality of copy sheets and a sensor SE7 for detecting the guide roller 195 and also for detecting whether copy paper is in existence or not.

The paddle wheel 180 is arranged with its axis inclined a predetermined angle from the horizontal state perpendicular to the dropping direction of copy paper, and is rotatively driven in the direction of arrow g with a motor MA by which a vane member 182 comes in contact with a copy paper conveyed into the staple tray 150 by its own weight, and the copy paper sheets are dropped one by one until they reach the lower edge regulating portion in a manner to have it energized in one direction to come into contact with an unillustrated side plate for making adjustment.

The stapler 190 itself is known well already as an electric-powered type, and the stapler which is driven by an electric motor manufactured by MAX is used in the present invention. A staple receiving stand is arranged on the same plane as that of the stopper 160, and the corner of a bunch of copy sheets adjusted and accommodated in the staple tray 150 is staplers. Other stapler than the one used in this embodiment may also be properly utilized.

A guide roller 195 is rotatably mounted at the lower portion of a lever 196 pivotally fixed to the guide plate 155 to prevent the leading end of the accommodated bunch of copy paper sheets from swelling. The guide plate 155 is provided with regulating levers 156,157 and a charge eliminating brush 158. The regulating levers 156,157 enter into the staple tray 150 by turning on of the solenoids SL1 and SL2 and is movable to the position of dotted line shown in FIG. 1, by which the fall of copy paper is regulated and each page is kept in order.

On the frame 212 arranged at the back of the stopper 160 in the finisher unit 50, a projected piece 213 is attached at the position opposite to the lower portion of copy paper accommodated in the staple tray 150 to face a long groove provided in the stopper 160. Accordingly, when the stopper 160 is moved in the direction of arrow f and opened the bottom of the staple tray 150 after stapling process, the projected piece 213 is projected from the long groove **160*b* to guide the lower portion of copy paper in place of the stopper 160. The copy paper after the stapling process is thus dropped on a guide plate 215 and is discharged onto a bucket or the stack basket 220**.

Figure 3:
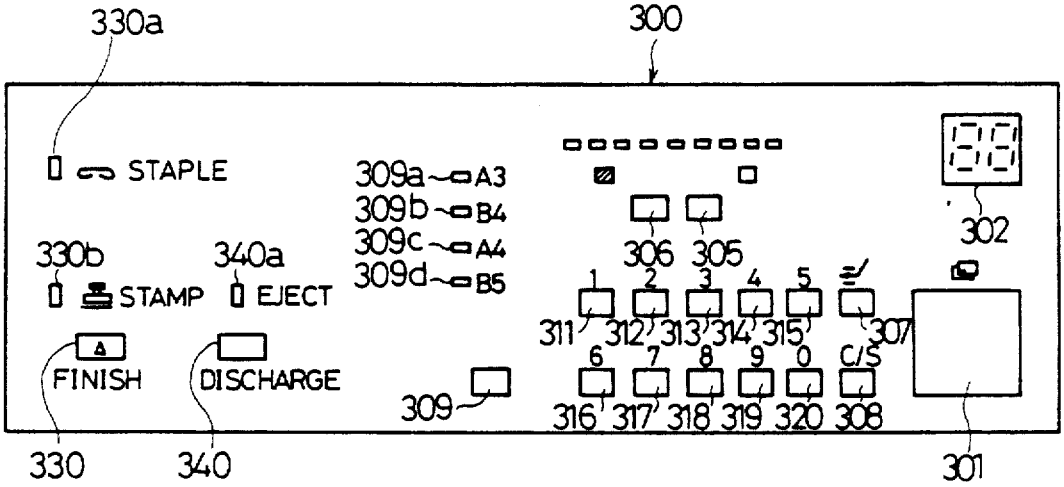
FIG. 3 is a plan view of an operation panel on the body of a copying apparatus.

Now, description will be made on an operation panel provided on the main body of a copying machine. The operation panel 300 is, as shown in FIG. 3, provided with operation keys and light emitting diodes (LED) which will be dscribed below.

301 Print key which is operated when copying operation is started.

302 7 segments type indicator for indicating the state of copying machine and the number of copy paper sheets.

305, 306 - Up-Down keys for setting image density.

307 Interruption key.

308 Clear-Stop key for releasing the number of sheets set or stopping copying operation.

309 Selection key for the size of paper.

**309*a*-309*d*** - Indicator for the size of paper selected

311-320 - Ten keys for setting the number of sheets to be copied.

330 Finish mode selection key (keys for selecting no stapling mode, stapling mode, stapling and stamping mode)

**330*a*** Indicator for indicating that stapling mode is being selected.

**330*b*** Indicator for indicating that stamping mode is being selected.

340 Discharge key which is operated when the paper in the staple tray 150 is discharged from the tray without stapling process and the like.

**340*a* Indicator for indicating that the paper is under discharging process from the tray 150**.

Description will then be made on an operation panel on the RDH30.

Figure 4:
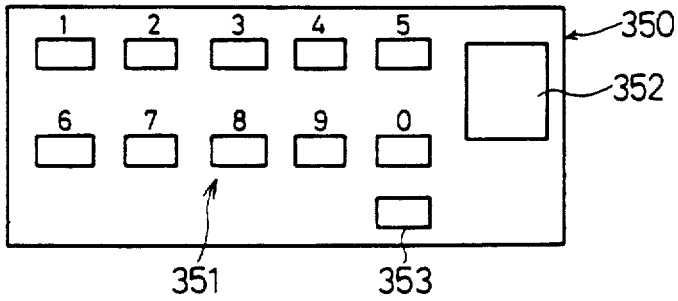
FIG. 4 is a plan view of an operation panel of an automatic original transporting device.

On the operation panel 350 of the RDH30, there are arranged, as shown in FIG. 4, ten keys 351 for inputting a number of originals, indicator 352 for indicating the number of originals inputted, and cancellation key 353 for cancelling indications. An inputting process for a number of originals to be set by the ten keys 351 is made only when original is set on the tray 31 of the RDH30, for which a sensor (not illustrated) is provided for detecting the existence of an original.

The control circuit of the main body of the copying machine and of the finisher unit will now be described below referring to FIG. 5.

The control circuit is arranged centering on microcomputers and includes a microcomputer CPU1 on the side of the main body of the copying machine (hereinafter simply called as CPU1), a microcomputer CPU2 on the side of the finisher (hereinafter simply called as CPU2), a microcomputer CPU3 on the side of the automatic original transporting device (hereinafter simply called as CPU3) and the like. To the input/output port of the CPU1, switch matrix 202 of various key switches on the operation panel such as 301, 305-309, 311-320, 330 and 340 is connected, and indication segment 302 is connected through the matrix 202 and a decoder 205. It is also arranged to output on/off signals from output port to a main motor in the main body of the copying machine and also to a developing motor and the like.

To input port of the CPU2, the sensor SE7 for detecting the existence of copy paper in the staple tray 150, the sensor SE4 for detecting the paper in the paper transport path 210 being transported to the staple tray 150, the sensor SE2 for detecting the paper in the paper transport path 211 being conveyed to the paper discharge tray 80 and the sensor SE6 for detecting the descending limit of the corner **131*b*** of the elevation frame under stamping mode which will be described later are connected respectively.

From output port, it is arranged to output on/off signals to a transport motor MX for discharging copied paper to the tray 80, to the motor of the stapler 190, to the solenoid SLX which drives a switchover member 70 for guiding and switching over the copied paper being transported from the main body of the copying machine either to the staple tray 150 or to the discharge tray 80, to a motor MS which drives a stamper 200, to a discharge solenoid SLC for opening the bottom 160 of the staple tray 150, to a paddle wheel driving motor MA and the like. To input port of the CPU3, a group of switches on the operation panel 350, indicator and the like are connected.

Data sample and output clock terminal SCK, interruption output terminal PCO, data output terminal SOUT and data input terminal SIN of the CPU1 are connected to clock input terminal SCK, interruption output terminal INT, data input terminal SIN and data output terminal SOUT of the CPU2 and CPU3 respectively.

Copying action of the main body of the copying machine is started by turning on the print key 301 on the operation panel 300. The copying action which will take place thereafter has already been described. In said copying operation, the paper selected by the key 309 is used and the number of sheets set by the ten keys 311-320 on the operation panel 300 on the main body are copied corresponding to the number of originals set by the ten keys 351 on the operation panel 350 of the RDH30 (when RDH is used).

The finisher unit 50 which is constructed as described above is operable in a no stapling mode, stapling mode and a stapling plus stamping mode. The selection for these modes is made by the selection key (rotation key) 330 on the operation panel 300.

When indication LED330*a* is turned on, it means that the stapling mode is being selected, and when indication LED330*b* is turned on, it means that the stamping mode is being selected. In this embodiment, LED330*b* is not turned on unless the LED330*a* is turned on. In other words, the stamping mode can only be selected together with stapling mode. When both of the LED330*a* and 330*b* are turned off, it means that no stapling mode is selected.

No stapling mode is an operation mode in which the copy paper discharged from the main body of the copying machine is accommodated on the paper discharge tray 80.

A shifting operation of the paper discharge tray 80 by shift mechanism 120 is automatically carried out by setting the number of copy paper sheets to be more than 2 or by setting the number of copy paper sheets to be more than 2 with the use of the RDH30.

The stapling mode is an operation mode wherein the copy paper sheets discharged from the main body of the copying machine are accommodated on the staple tray 150 and they are adjusted by the paddle wheel 180, then a bunch of the copy paper sheets is stapled by operating the stapler 190, and thereafter, the stapled bunch of copy paper sheets is accommodated in the stack basket 220.

When the RDH30 is in use and after adjustment is made for final sheet of copy paper, or when the RDH30 is not in use and the discharge key 340 on the operation panel is pressed, the stapler 190 is driven and the stopper 160 is opened by turning on the discharge solenoid SLC to drop and discharge copy paper downwardly.

The stamp mode is an operation mode to stamp the uppermost page of a group of copy paper sheets accommodated in the staple tray 150 by the stamper 200 and the operation can be carried out together with the stapling mode. The stamp operation is carried out just after the stapling process has been finished provided that the discharge key 340 is turned on. In this case, the elevation member 131 is brought down by the motor MS to the position where it is detected by the sensor SE6 and in cooperation with this operation, the stamper 200 is moved for stamping. At this time, the stamp receiving stand 300 supports the back of the bunch of copy paper sheets to provide for clear stamping. The stopper 160 is opened after the stamp process.

Particularly in the stapling mode (including the stapling mode plus stamp mode) in this embodiment, when copy paper sheets on the staple tray 150 reach the amount containable in the tray, the solenoid SLX is turned off to return the switchover member 70 to the position of solid line shown in FIG. 2 and the copy paper sheets following are directed to the paper discharge tray 80, under the state of which the copying operation can be continued corresponding to the number of originals.

If the discharge key 340 is pressed under such state, the stapler 190 and stamper 200 are not operated and the stopper 160 is immediately opened to discharge the copy paper into the tray as it is. Accordingly, said copy paper and the copy paper on the discharge tray 80 are thereafter adjusted properly to be ready for stapling and stamping according to requirement. The above-mentioned non-operation of the stapler 190 and stamper 200 can be automatically performed with the paper path switchover operation when the copy paper sheets have reached the amount containable in the tray 150 not relying on manual operation. In this embodiment, the number of sheets containable in the staple tray 150 corresponds to the number of sheets which can be processed by the stapler 190. If the number of sheets which can be processed is less than the number of sheets containable, it is only necessary to switch over the paper path when the copy paper sheets have reached the number of sheets which can be processed.

The action of the microcomputer CPU1 and CPU2 will now be described. In the following description, the letter 'S' and the numeral followed indicate the step of operational flow chart in the CPU1 and CPU2. Prior to entering into further detailed description, the wording 'on edge' and 'off edge' will also be defined below.

The 'on edge' is defined as a state of variation when the state of switch, sensor, signal and the like are changed from off state to on state. The 'off edge' is defined as a state of variation when the state of switch, sensor, signal and the like are changed from on state to off state.

Figure 6:
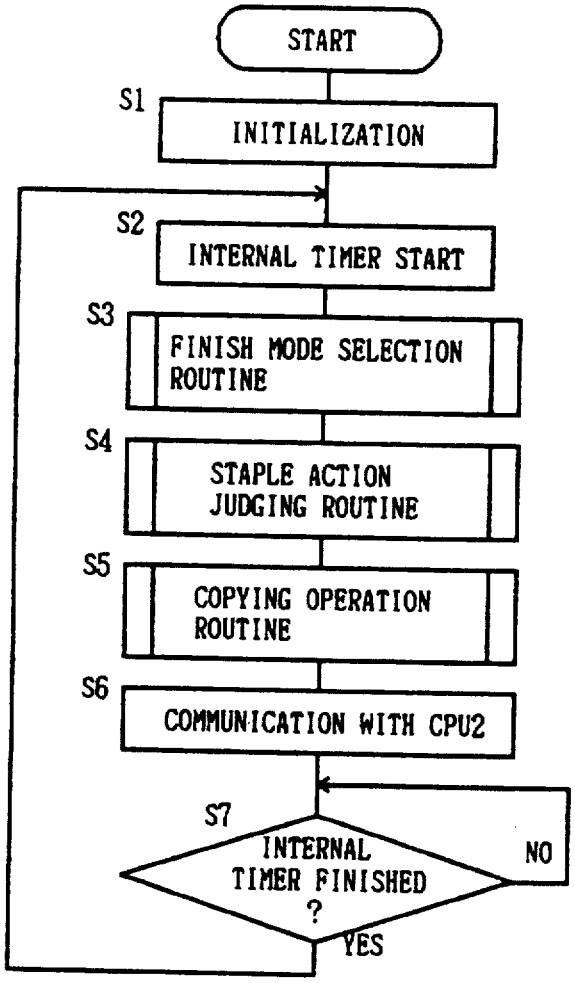
FIG. 6 is a flow chart of main routine of operational control of micro computer on the side of main body of a copying apparatus.

The action of the CPU1 will now be described with reference to the flow chart illustrated in FIGS. 6 and 7. FIG. 6 shows a main routine of control by the CPU1. According to this routine, when the CPU1 is reset and a program is started, initialization of the microcomputer for clearing RAM and setting various registers and making the main body of the copying machine at initial state are performed. At S2, an internal timer which is stored in the CPU1 is started with the value set by the initialization. Thereafter, at S3-S6, each subroutine is successively called and when all proceeds of the subroutines are finished, one routine is completed upon finishing the internal timer initially set at S7, and the program is returned to S2. S3 indicates the finish mode selection routine, S4 the stapling action judging routine, S5 the copying coperation routine and S6 the communication routine with the CPU2 respectively.

Figure 7:
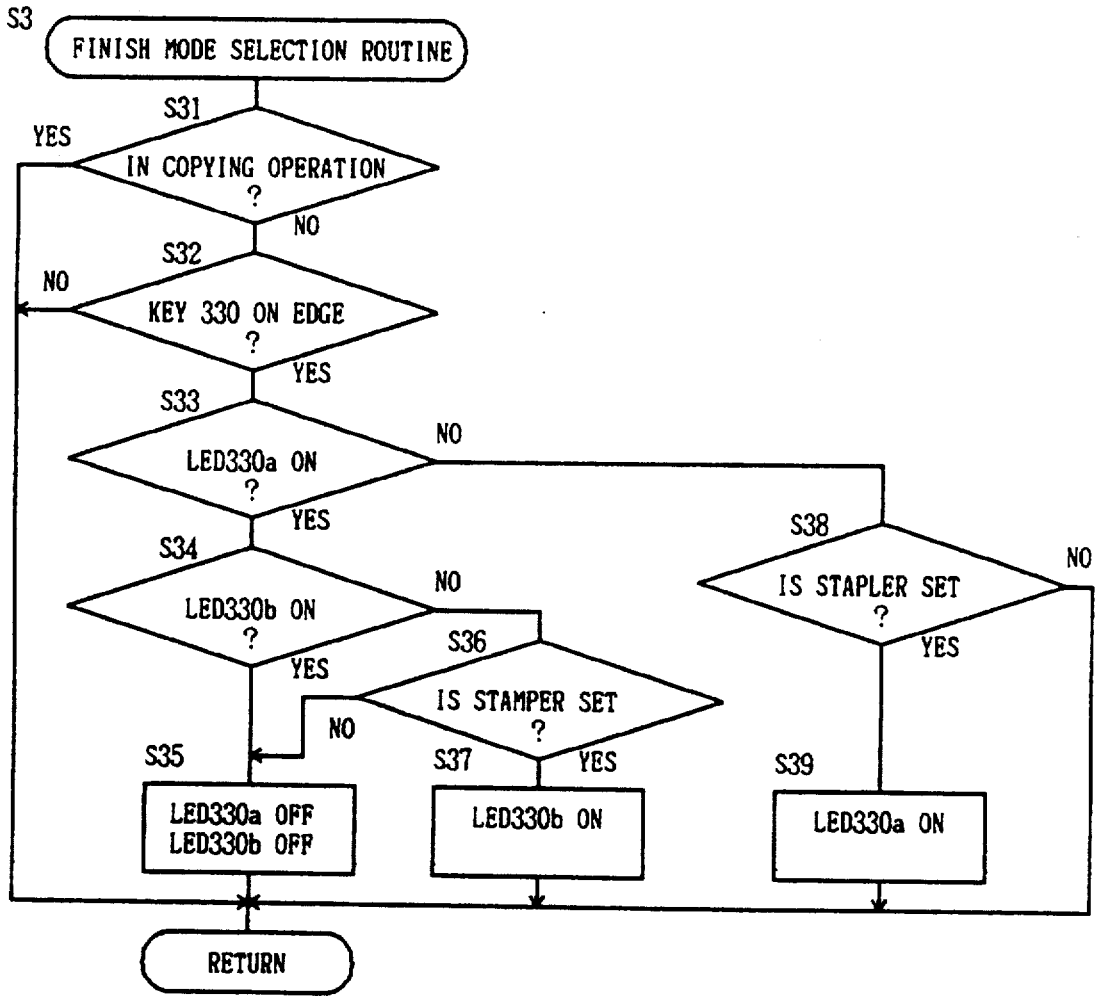
FIG. 7 is a flow chart of finishing mode selection subroutine.

Description will then be made on the finish mode selection routine referring to FIG. 7. At S31, judgement is made whether a copying operation is being taken or not, and if a copying operation is being taken, the program is immediately returned to main routine. If copying operation is not being taken, judgement is made as to whether finish mode selection key 330 is on edge or not at S32, and if it is not on edge, the program is returned to main routine, while if it is on edge, judgement is made whether indication LED330*a* is on or not at S33. At this time, if the LED330*a* is on, judgement is made whether indication LED330*b* is on or not at S34, and if it is on, LED330*a* and LED330*b* are turned off at S35. If LED330*b* is not on at S34, judgement is made whether stamper is set or not at S36, and if it is not set, the program proceeds to S35, while if it is set, the LED330*b* is turned on at S37. When LED330*a* is not turned on at S33, the program proceeds to S38 whereat judgement is made whether stapler is set or not, and if it is not set, the program is returned to main routine, while if it is set, LED330*a* is turned on at S39. When the LED330*b* is turned on at S37, the LED330*a* is already turned on at S33, the turning on of the LED330*b* is premised on the turning on of the LED330*a*. In other words, the stapling mode is simultaneously selected when stamping mode is selected.

In case when the stapler is not set at S38, the LED3-30*a* is not turned on even if the key 330 is pressed. Similarly, if the stapler is not set with the stamper at S36, the LED330*b* is not turned on even if the key 330 is pressed, only resulting in turning off the LED330*a*. In other words, if the finisher unit is not equipped with the main body, neither staple mode nor stamp mode can be selected even if the key 330 is pressed. Even if the finisher unit is equipped with the main body, if the stamper is not mounted in the finisher unit, the stamp mode is not selected and either only the staple mode or the no stapling mode is selected by operating the key 330.

Figure 8:
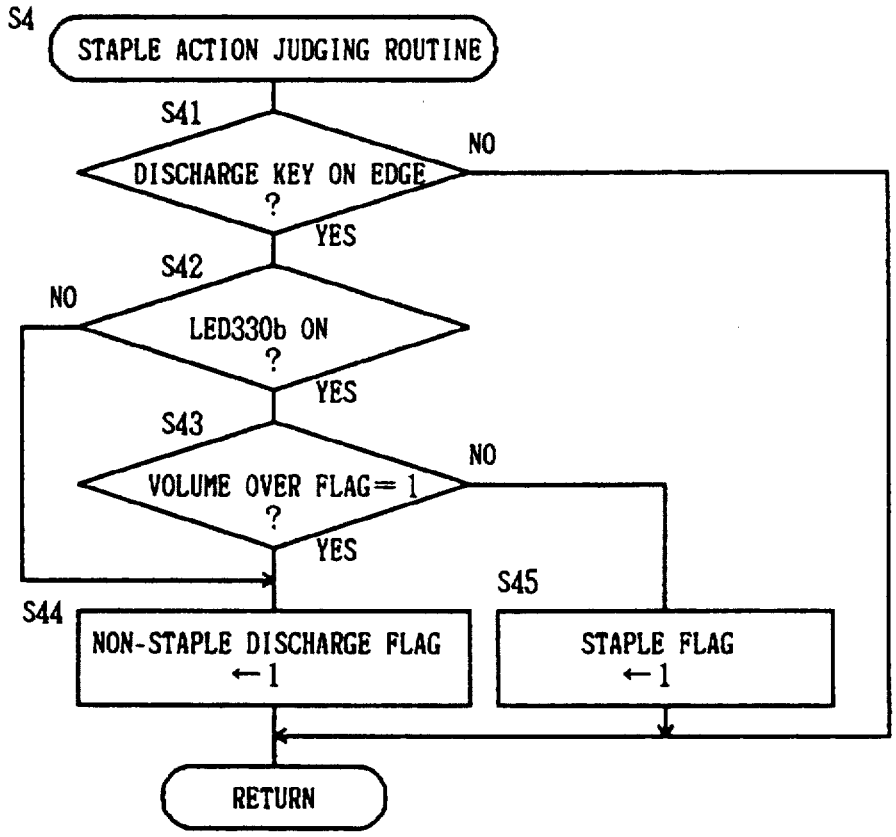
FIG. 8 is a flow chart of stapling action judging subroutine.

Stapling action judging routine will now be described with reference to FIG. 8. At S41, on edge of the discharge key 340 is first judged, and if the discharge key 340 is not on edge, the program is immediately returned to main routine. If it is on edge, judgement is made whether the LED330*b* is turned on or off at S42. If the LED330*b* is turned on, in other words, if the staple mode is being selected, the program proceeds to S43, and if the LED330*b* is turned off, in other words, if the non-staple mode is being selected, the program proceeds to S44.

At S43, judgement is made whether volume over flag, which will be described later, is set at "1" or not. If the volume over flag is "0", in other words, if the number of sheets accommodated is not exceeding permissible number of containable number of sheets, staple flag is set at "1" for stapling process at S45.

If the volume over flag is "1" at S43 or LED330*b* is turned off at S42, in other words, if the number of sheets accommodated exceed the permissible number of containable sheets or non staple mode is being selected, non-staple discharge flag is set at "1" at S44.

Staple flag is set at "1" when the RDH30 is not in use as in the case when discharge key 340 is pressed as described at S45 above, while when RDH30 is in use, the staple flag is set at "1" when the number of sets input by the ten key 351 of the panel 350 on the RDH30 has finished copying operation and every time when they are accommodated in the staple tray 150.

Figure 9:
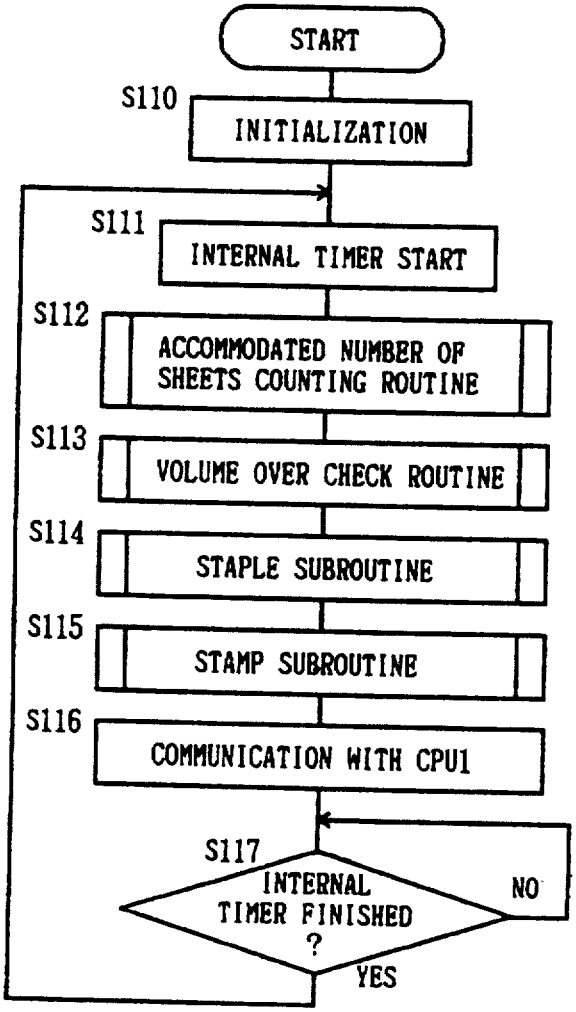
FIG. 9 is a flow chart of main routine of operational control of micro computer on the side of finisher.

The main routine of control by the CPU2 will be described referring to FIG. 9. According to this routine, when the CPU2 is reset and a program is started, at S110, RAM is cleared and initialization of microcomputer for setting various registers and initialization of the finisher unit 50 are performed. Then, an internal timer which is stored in the CPU2 with its value set by said initialization is started at S111. At the following steps S112-S116, subroutines are successively called and when all the subroutine processes is finished, one routine is completed upon finishing the internal timer initially set at S117, and thereafter, the program is returned to S20.

In this main routine, S112 is a subroutine for counting the number of sheets accommodated in the staple tray 150, S113 a volume over check subroutine for checking whether the number of sheets accommodated in the staple tray 150 has reached the containable number of sheets therein, S114 a staple subroutine for stapling and discharging the copy paper sheets in the staple tray 150 by the stapler 190 and S115 a subroutine for stapling the copy paper in the staple tray 150 by the stapler 190 and stamping them by the stamper 200 with next process for discharging. S116 is a subroutine provided for communication with the CPU1.

Figure 10:
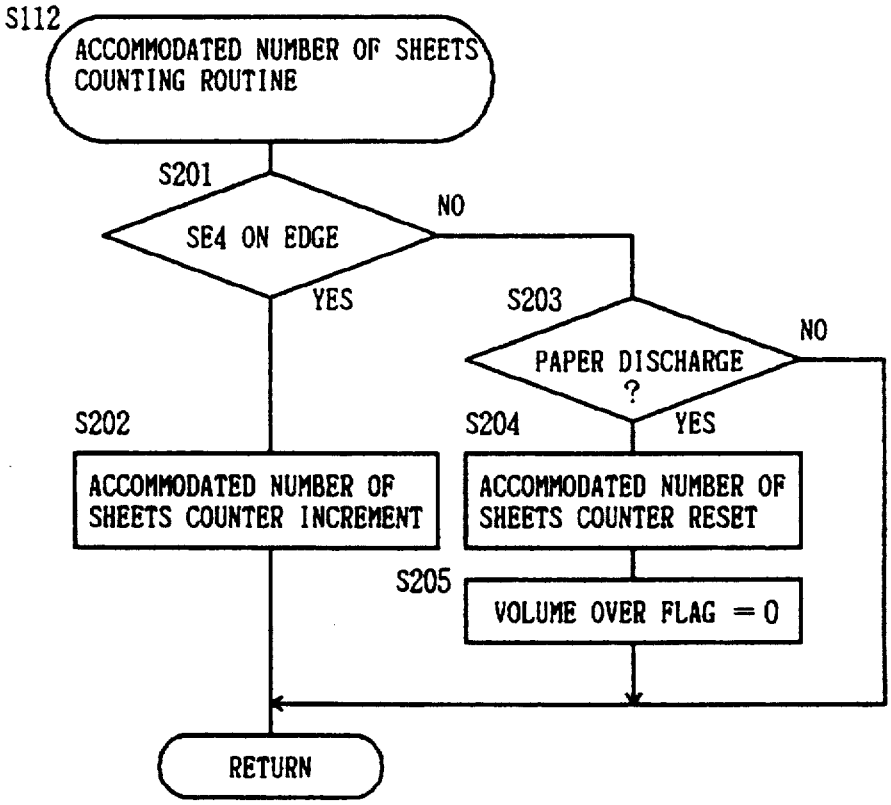
FIG. 10 is a flow chart of subroutine for counting the number of sheets accommodated.

Now, description will be made on a subroutine for counting accommodated number of sheets referring to FIG. 10. At S201, every time when there is on edge of sensor SE4, the program proceeds to S202 and increments counter for the number of sheets accommodated. When there is no on edge of the sensor SE4 at S201, the program proceeds to S203, and if there is a copy paper discharged from the staple tray 150, the counter for accommodated number of sheets is cleared to 0 at S204 irrespective of whether the stapling process has been performed, and the volume over flag is set at "0" at S205.

Figure 11:
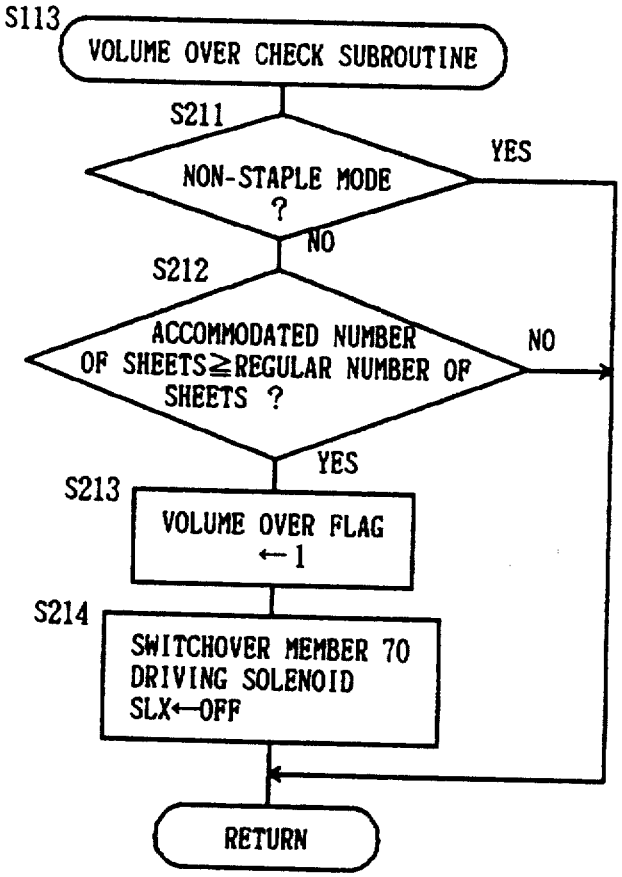
FIG. 11 is a flow chart of subroutine for checking the value exceeded.

The volume over check subroutine will then be described referring to FIG. 11. At S211, judgement is made whether it is staple mode or not, and if it is non-staple mode, the program is immediately returned. If it is staple mode, judgement is made whether the number of sheets accommodated in the staple tray have reached regular number of sheets at S212, and if it has not reached the regular number of sheets, the program is returned to main routine. However, if the number of sheets have reached the regular number of sheets, the volume over flag is set at "1" at S213, and the program proceeds to S214 and the solenoid SLX is turned off to guide the copy paper being transported from the main body to the paper discharge tray 80. At S212, judgement may be made whether the total number of sheets in the main body of the copying machine and the sheets accommodated in the staple tray have reached the permissible number of sheets in the staple tray.

Figure 12:
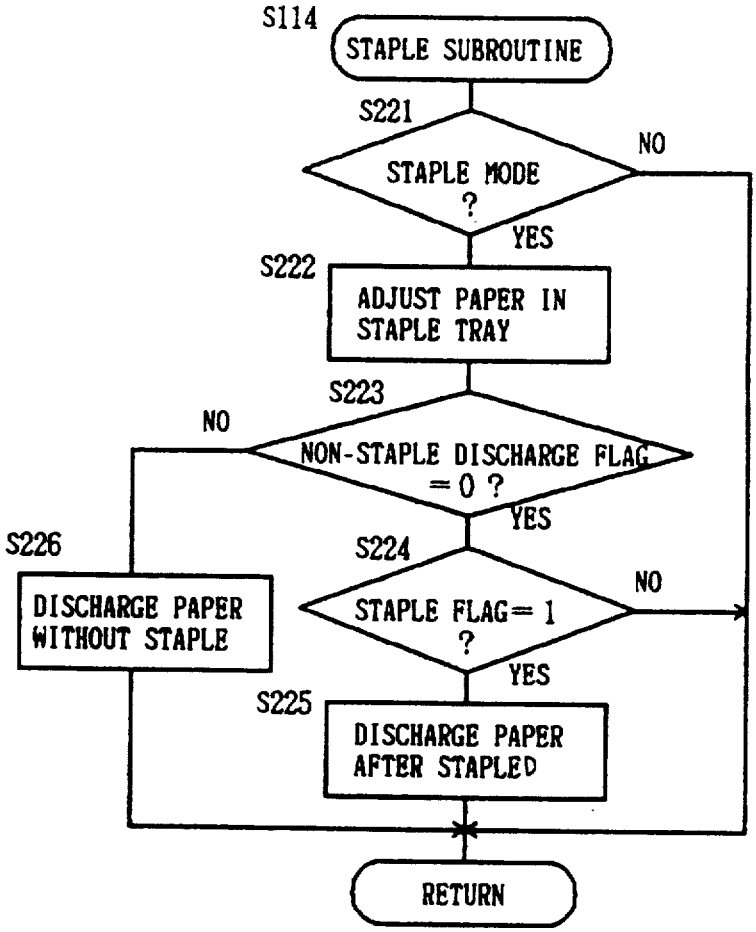
FIG. 12 is a flow chart of stapling subroutine.

The staple subroutine will be described referring to FIG. 12. First, judgement is made at S221 whether it is staple mode or not. If it is not staple mode, the program is immediately returned, and if it is staple mode, the program proceeds to S222 to adjust the paper accommodated in the staple tray 150. At S223, judgement is made whether the non-staple discharge flag set in the main body is reset at "0". If the non-staple discharge flag is set at "1", in other words, if the discharge key 340 on the operation panel of the main body is pressed under the state the accommodated number of sheets has exceeded the permissible number of sheets or the discharge key 340 is pressed under non-staple mode, the copy paper accommodated in the staple tray 150 is discharged without the stapling process at S226.

If non-staple discharge flag is "0" at S223, judgement is made whether the staple flag is set at "1" or not at S224. If the staple flag is "0", the program is returned as it is since a series of copying operation are being performed. While, if the staple flag is "1", the copy paper sheets accommodated in the staple tray 150 are stapled and discharged.

Figure 13:
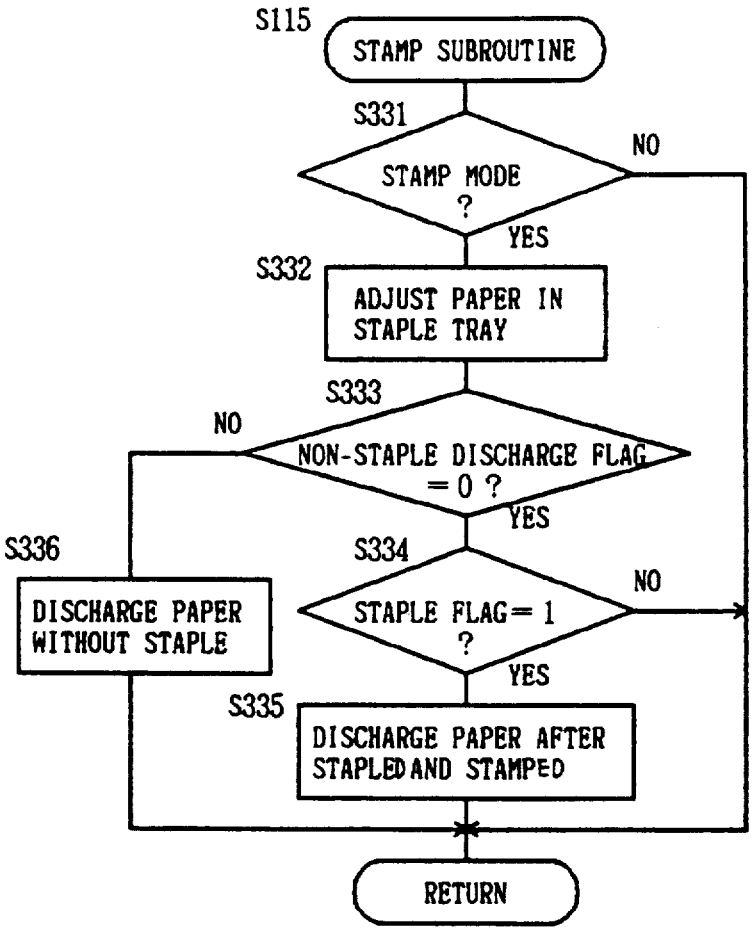
FIG. 13 is a flow chart of stamp subroutine.

Now, description will be made on stamp subroutine with reference to FIG. 13. First, judgement is made whether it is stamp mode or not at S331. If it is not stamp mode, the program is immediately returned, while if it is stamp mode, the program proceeds to S332 to adjust the paper accommodated in the staple tray 150. At S333, judgement is made whether the non-staple discharge flag set in the main body is "0" or not. If the non-staple discharge flag is set at "1", in other words, the discharge key 340 on the operation panel of the main body is pressed under the state that the number of sheets accommodated has exceeded the permissible number of sheets, or if the discharge key 340 is pressed under non-staple mode, the copy paper accommodated in the staple tray 150 are discharged without stapling process at S336. If the non-staple discharge flag is "0" at S333, judgement is made whether the staple flag is set at "1" or not. If the staple flag is "0", the program is returned as it is since a series of copying operations are being performed. While, if the staple flag is "1", the copy paper sheets accommodated in the staple tray 150 are discharged after they are stapled and stamped.

The present invention is not limited to the embodiment described above and may be applied to various modes. For instance, in the above embodiment, the finish mode selection key 330, the indicators 330*a* and 330*b* are provided on the operation panel 300 of the main body 1 of the copying machine, however, the selection key and the indicators may be provided on the finisher unit.

However, it will be advantageous if they are arranged on the operation panel of the main body since the selection key and corresponding indicators are properly utilized even if the finisher unit mounted to the main body is provided with only a staple tray or a stamper.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus, comprising:

an image forming means for forming an image on a sheet of copy paper;

a stapling means for accommodating and stapling a number of the copy paper sheets on which the image is formed, the stapling means being capable of stapling a predetermined number of copy paper sheets;

a discharging means for accommodating the copy paper sheets on which the image is formed without stapling them;

a transporting means for selectively forwarding the image formed copy paper either to the stapling means or to the discharging means; and a control means for controlling the transporting means so as to transport the succeeding copy paper sheets to the discharging means when the number of copy paper sheets accommodated in the stapling means has reached the predetermined number of sheets.

2. The copying apparatus as defined in claim 1, further includes a counting means for counting the number of copy paper sheets accommodated in the stapling means.

3. The copying apparatus as defined in claim 2, wherein the control means prohibits stapling action of the stapling means when a number of copy paper sheets accommodated in the stapling means has reached the predetermined number of sheets.

4. A copying apparatus, comprising:

an image forming means for forming an image on a sheet of copy paper;

a stapling means for accommodating and stapling a number of the copy paper sheets on which the image is formed, and the stapling means being capable of stapling a predetermined number of the copy paper sheets;

a discharging means for accommodating the copy paper sheets on which the image is formed without stapling them;

a first transporting means having a first path for connecting the image forming means and the stapling means and forwarding the image formed copy paper to the stapling means;

a second transporting means having a second path for connecting a predetermined intermediate portion in the first transporting path and the discharging means and forwarding the image formed copy paper to the discharging means;

a switchover means arranged on a connecting portion between the first and second paths for selectively forwarding the copy paper sheets being conveyed from the image forming unit to the second path;

a detecting means for detecting that the number of copy paper sheets accommodated in the stapling means has reached a predetermined number of sheets; and a control means for controlling the switchover means so as to transport succeeding copy paper sheets to the discharging means in response to the detecting means during a copying operation.

5. A copying apparatus, comprising:

an image forming means for forming an image of an original on an exposure platen onto a sheet of copy paper;

an original circulating transport means having a tray for placing a plurality of originals to send out an original on the tray to the exposure platen to form an image of the original and return the original to the tray again after the image is formed;

a stapling means for accommodating and stapling a number of copy paper sheets on which the image is formed, the stapling means being capable of stapling a predetermined number of copy paper sheets;

a counting means for counting a number of copy paper sheets accommodated in the stapling means;

a discharging means for accommodating the image formed copy paper without stapling them;

a transporting means for selectively forwarding the image formed copy paper either to the stapling means or to the discharging means;

an output means for outputting a stapling instruction to actuate the stapling means every time the original circulating transport device moves the original on the tray through one round of circulation;

a first control means for actuating the stapling means in response to the stapling instruction; and a second control means for controlling the transporting means so as to transport succeeding copy paper sheets to the discharging means when the number of sheets accommodated in the stapling means has reached the predetermined number of sheets and prohibit the action of the first control means.

6. The copying apparatus as defined in claim 5, further comprising:

a mode switchover means for selectively switching over a first mode and a second mode; and a third control means for controlling the transporting means so as to transport the copy paper to the stapling means under the first mode and transport the copy paper to the discharging means under the second mode.

7. A copying apparatus, comprising:

an image forming means for forming an image of an original onto a sheet of copy paper;

a stapling means for accommodating and stapling a number of copy paper sheets on which the image is formed, the stapling means being capable of stapling a predetermined number of copy paper sheets;

a counting means for counting the number of copy paper sheets accommodated in the stapling means;

a discharging means for accommodating the copy paper sheets on which the image is formed without stapling them;

a transporting means for selectively transporting the image formed copy paper either to the stapling means or to the discharging means;

an instruction input means for inputting instruction for starting a stapling operation;

a first control means for actuating the stapling means in response to the stapling instruction; and a second control means for controlling the transporting means so as to transport succeeding copy paper sheets to the discharging means when the number of copy paper sheets accommodated in the stapling means has reached the predetermined number of sheets and prohibit the action of the first control means.

8. The copying apparatus as defined in claim 7, further comprising:

a mode switchover means for selectively switching over a first and second mode; and a third control means for controlling the transporting means so as to convey the copy paper to the stapling means under the first mode and to convey the copy paper to the discharging means under the second mode.

9. In a copying apparatus which produce copies of originals and binds the same, a method for controlling the copying apparatus comprising the steps of:

producing a desired number of copies of originals successively;

transporting the copies to a binding device;

counting the number of copies transported to the binding device; and discharging the succeeding copies to a discharging tray when the number of copies has reached a predetermined number.

* * * * *